US009260838B2

(12) United States Patent
Sawada et al.

(10) Patent No.: US 9,260,838 B2
(45) Date of Patent: Feb. 16, 2016

(54) CONTROL SYSTEM FOR CONSTRUCTION MACHINE

(75) Inventors: Shingo Sawada, Tokyo (JP); Kouji Ishikawa, Kasumigaura (JP); Hidetoshi Satake, Tsuchiura (JP); Takako Satake, legal representative, Ishioka (JP); Shinji Nishikawa, Kasumigaura (JP); Takatoshi Ooki, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 38 days.

(21) Appl. No.: 14/111,192

(22) PCT Filed: Apr. 5, 2012

(86) PCT No.: PCT/JP2012/059405

§ 371 (c)(1),
(2), (4) Date: Oct. 11, 2013

(87) PCT Pub. No.: WO2012/153586

PCT Pub. Date: Nov. 15, 2012

(65) Prior Publication Data

US 2014/0039768 A1 Feb. 6, 2014

(30) Foreign Application Priority Data

May 11, 2011 (JP) ..... 2011-106572

(51) Int. Cl.
*E02F 9/22* (2006.01)
*E02F 9/26* (2006.01)
(Continued)

(52) U.S. Cl.
CPC ..... *E02F 9/22* (2013.01); *E02F 9/2235* (2013.01); *E02F 9/2246* (2013.01);
(Continued)

(58) Field of Classification Search
CPC ..... E02F 9/2246; E02F 9/2296; E02F 9/2235; E02F 9/2025; E02F 9/2292; E02F 9/2253; E02F 9/26; E02F 9/0866; E02F 9/2075; E02F 9/20; E02F 9/2079; B60W 2300/17; B60W 30/1882; B60W 2510/0638; B60W 2510/1005; B60W 2540/10; B60W 30/182; B60W 30/188; B60W 10/026; B60W 10/103
USPC ..... 701/1, 22, 50, 51, 54, 102, 114
See application file for complete search history.

(56) References Cited

U.S. PATENT DOCUMENTS 5,850,341 A * 12/1998 Fournier et al. ..... 701/50
6,119,054 A 9/2000 Miki et al.
(Continued)

FOREIGN PATENT DOCUMENTS

EP 0989242 A1 3/2000
GB 2457401 A 8/2009
(Continued)

OTHER PUBLICATIONS

International Preliminary Report on Patentability received in International Application No. PCT/JP2012/059405 dated Nov. 21, 2013.
(Continued)

*Primary Examiner* — Truc M Do
(74) *Attorney, Agent, or Firm* — Mattingly & Malur, PC

(57) ABSTRACT

A fuel-efficient hydraulic fluid has a lower viscosity than a standard hydraulic fluid, a pressure loss decreases, and thus, when control based on a standard model is exercised, the speeds of various actuators increase. However, the speeds need not be increased beyond the speeds of the standard model. Instead, it is preferred that fuel efficiency be improved. As a result, an engine revolution speed decreases by 50 rpm and a pump torque decreases by 5%. This reduces an engine output. Therefore, when a hydraulic fluid is changed from the standard hydraulic fluid to the fuel-efficient hydraulic fluid, the fuel efficiency can be improved while maintaining operability equivalent to that of the standard model. Hence, the fuel efficiency can be improved while maintaining the operability when an item affecting the fuel consumption is replaced. In addition, the settings can be changed with ease by a service technician.

7 Claims, 22 Drawing Sheets

(51) Int. Cl.
*F15B 21/04* (2006.01)
*F15B 21/08* (2006.01)
*F02D 29/04* (2006.01)

(52) U.S. Cl.
CPC ..... *E02F 9/2296* (2013.01); *E02F 9/26* (2013.01); *F02D 29/04* (2013.01); *F15B 21/04* (2013.01); *F15B 21/082* (2013.01); *F15B 2211/20523* (2013.01); *F15B 2211/20546* (2013.01); *F15B 2211/6651* (2013.01); *F15B 2211/6652* (2013.01); *F15B 2211/6658* (2013.01); *F15B 2211/88* (2013.01)

(56) References Cited

U.S. PATENT DOCUMENTS

| | | | | |
|---|---|---|---|---|
| 6,923,285 | B1 * | 8/2005 | Rossow et al. | 180/272 |
| 7,400,959 | B2 * | 7/2008 | Price et al. | 701/50 |
| 7,738,979 | B2 * | 6/2010 | Schmuck et al. | 700/85 |
| 8,392,075 | B2 * | 3/2013 | Mindeman et al. | 701/50 |
| 8,401,751 | B2 * | 3/2013 | Jacobson et al. | 701/58 |
| 8,768,577 | B2 * | 7/2014 | Lougheed et al. | 701/50 |
| 8,914,215 | B2 * | 12/2014 | Faivre et al. | 701/84 |
| 2003/0019681 | A1 * | 1/2003 | Nakamura | 180/307 |
| 2003/0144750 | A1 | 7/2003 | Watanabe et al. | |
| 2003/0156949 | A1 * | 8/2003 | Shimomura et al. | 417/213 |
| 2004/0088103 | A1 * | 5/2004 | Itow et al. | 701/110 |
| 2004/0186657 | A1 * | 9/2004 | Ritter et al. | 701/114 |
| 2005/0173570 | A1 * | 8/2005 | Tanaka et al. | 241/36 |
| 2006/0113140 | A1 * | 6/2006 | Nakamura et al. | 180/306 |
| 2006/0229786 | A1 * | 10/2006 | Sawada | 701/50 |
| 2006/0235595 | A1 * | 10/2006 | Sawada | 701/50 |
| 2006/0241837 | A1 * | 10/2006 | Jarrett et al. | 701/50 |
| 2006/0241838 | A1 * | 10/2006 | Mongiardo et al. | 701/50 |
| 2006/0287792 | A1 * | 12/2006 | Jarrett | 701/50 |
| 2007/0101708 | A1 * | 5/2007 | Ohigashi et al. | 60/431 |
| 2007/0193262 | A1 * | 8/2007 | Iwamoto | 60/421 |
| 2007/0204604 | A1 * | 9/2007 | Naruse | 60/433 |
| 2007/0204605 | A1 * | 9/2007 | Itoga et al. | 60/433 |
| 2007/0221168 | A1 * | 9/2007 | Katrak et al. | 123/350 |
| 2007/0227137 | A1 * | 10/2007 | Naruse | 60/426 |
| 2008/0072588 | A1 * | 3/2008 | Ariga et al. | 60/449 |
| 2008/0154466 | A1 * | 6/2008 | Shenoy et al. | 701/50 |
| 2008/0254939 | A1 | 10/2008 | Ichimura | |
| 2009/0240406 | A1 * | 9/2009 | Fukushima et al. | 701/54 |
| 2010/0042281 | A1 * | 2/2010 | Filla | 701/22 |
| 2010/0122522 | A1 * | 5/2010 | Tsukada et al. | 60/284 |
| 2010/0167873 | A1 * | 7/2010 | Akiyama et al. | 477/68 |
| 2010/0229538 | A1 * | 9/2010 | Bloms et al. | 60/295 |
| 2010/0235060 | A1 * | 9/2010 | Yamada | 701/50 |
| 2010/0262353 | A1 * | 10/2010 | Hyodo et al. | 701/102 |
| 2010/0332102 | A1 * | 12/2010 | Akiyama et al. | 701/99 |
| 2011/0010058 | A1 * | 1/2011 | Saito et al. | 701/50 |
| 2011/0167811 | A1 * | 7/2011 | Kawaguchi et al. | 60/395 |
| 2012/0029775 | A1 * | 2/2012 | Peters et al. | 701/50 |
| 2012/0089307 | A1 * | 4/2012 | Hyodo et al. | 701/52 |
| 2012/0094801 | A1 * | 4/2012 | Hyodo et al. | 477/111 |
| 2012/0100959 | A1 * | 4/2012 | Hyodo et al. | 477/111 |
| 2012/0245760 | A1 * | 9/2012 | Ikeya | 701/1 |
| 2012/0277944 | A1 * | 11/2012 | Kaneko et al. | 701/22 |
| 2012/0304634 | A1 * | 12/2012 | Ooi et al. | 60/423 |
| 2012/0304635 | A1 * | 12/2012 | Ooi et al. | 60/431 |
| 2012/0330500 | A1 * | 12/2012 | Kamada et al. | 701/33.4 |
| 2013/0006495 | A1 * | 1/2013 | Tajima et al. | 701/102 |
| 2013/0090835 | A1 * | 4/2013 | Take et al. | 701/103 |

FOREIGN PATENT DOCUMENTS

| | | | |
|---|---|---|---|
| JP | 06/057787 | A | 3/1994 |
| JP | 08-093520 | A | 4/1996 |
| JP | 10-237904 | A | 9/1998 |
| JP | 2002-188177 | A | 7/2002 |
| JP | 2010-022239 | A | 2/2010 |
| WO | 01/73218 | A1 | 10/2001 |
| WO | 2006/035589 | A1 | 4/2006 |

OTHER PUBLICATIONS

European Search Report received in corresponding European Application No. 12782784 dated Mar. 17, 2015.

* cited by examiner

Fig.11

| SELECTED ITEM | SELECTED ITEM STATE | ENGINE REVOLUTION SPEED [rpm] | PUMP TORQUE [%] |
|---|---|---|---|
| FRONT | STANDARD FRONT | ±0 | ±0 |
| | REINFORCED FRONT | +50 | +5 |
| | LIGHTWEIGHT FRONT | −50 | −5 |
| COUNTERWEIGHT | STANDARD COUNTERWEIGHT | ±0 | ±0 |
| | HEAVY COUNTERWEIGHT | +50 | +5 |
| | LIGHT COUNTERWEIGHT | −50 | −5 |
| HYDRAULIC FLUID | STANDARD HYDRAULIC FLUID | ±0 | ±0 |
| | FUEL-EFFICIENT HYDRAULIC FLUID | −50 | −5 |
| CONDUIT | STANDARD CONDUIT | ±0 | ±0 |
| | INCREASED-DIAMETER CONDUIT | −50 | −5 |

CONTROL SYSTEM FOR CONSTRUCTION MACHINE

TECHNICAL FIELD

The present invention relates to a control system for controlling an engine, a pump, and other components of a hydraulic excavator or other construction machine. More specifically, the present invention relates to a construction machine control system that is capable of changing an engine revolution speed setting and a pump torque setting.

BACKGROUND ART

A construction machine such as a hydraulic excavator generally includes a diesel engine. The diesel engine drives a hydraulic pump of a variable displacement type. A hydraulic fluid discharged from the hydraulic pump drives a plurality of hydraulic actuators to perform necessary operations. The engine includes a fuel injection device. The fuel injection device controls a fuel injection amount, thereby controlling an engine revolution speed and an output torque.

Meanwhile, pump torque control is exercised over the hydraulic pump, which is rotationally driven by the engine, in order to prevent the engine from being excessively loaded. The pump torque control is exercised to prevent the maximum torque of the hydraulic pump from exceeding a setting by reducing the displacement volume of the hydraulic pump in accordance with an increase in the load pressure of the hydraulic pump.

A predetermined revolution speed is basically selected for the engine by using an engine control dial. Besides, the revolution speed of the engine is controlled depending on the situation. An appropriate pump toque is then set in accordance with such revolution speed control.

Optimizing the engine revolution speed setting and the pump torque setting makes it possible to provide improved fuel efficiency while maintaining the operability of the hydraulic excavator.

A control device for controlling an engine and a pump of a construction machine is disclosed, for instance, in Patent Document 1. The control device provides improved fuel efficiency by automatically controlling an engine revolution speed and a pump torque in accordance with the work to be performed.

The control device (control system) is a construction machine control device that controls the engine revolution speed by displacing the rack of an all-speed governor to increase or decrease the fuel injection amount, uses the engine to drive the pump, and controls the torque of the pump with a torque setup regulator. The control device includes a controller that detects the amount of displacement with a rack sensor and calculates an effective engine load factor by performing a stabilization process on the displacement amount of the rack. Further, work modes for multiple stages, which depend on the combinations of the engine revolution speed and pump torque, are set in the controller so as to control an engine revolution speed setting device and a torque setup regulator in accordance with a work mode designated by the controller. Furthermore, intermediate work modes included in the multiple stage work modes are provided with a region for switching to a next-stage work mode, a stabilized region, and a region for switching to a previous-stage work mode. Moreover, a highest-stage work mode is provided with a stabilized region and a region for switching to a previous-stage work mode. A lowest-stage work mode is provided with a region for switching to a next-stage work mode and a stabilized region. In addition, a switching region of each work mode has a portion that overlaps with a stabilized region in the next or previous stage work mode designated by the switching region. Meanwhile, when the effective engine load factor is above a predetermined value and a switching region in a certain work mode persists for a period not shorter than a predetermined period of time, control is exercised to switch to the next or previous stage work mode designated by the switching region.

PRIOR ART LITERATURE

Patent Document

Patent Document 1: JP, A 8-093520

SUMMARY OF THE INVENTION

Problem to be Solved by the Invention

When a product is manufactured at a factory, a standard model formed of standard items (e.g., a front device) is mass-produced. However, when the product is to be shipped out of the factory, some items may be replaced as needed to meet the request of a customer.

Further, in recent years, it is frequent that a leasing company purchases a large number of construction machines and leases them to a construction company or other customer. When purchasing the construction machines, the leasing company generally purchases standard models. However, when leasing the construction machines to the customer, the leasing company sometimes replaces some items of the construction machines as needed to meet the request of the customer.

Prior-art control systems are designed on the assumption that they will be used with standard models of construction machines. Therefore, if some items of a construction machine, particularly, items affecting the fuel consumption, are replaced, desired effects may not be obtained.

Further, when engine revolution speed and pump torque settings are to be changed in accordance with item replacements, a high level of technical expertise is required to obtain desired effects.

An object of the present invention is to provide a construction machine control system that is not only capable of providing improved fuel efficiency without sacrificing the operability of a construction machine by changing the setting of an engine revolution speed and the setting of a pump torque in accordance with an item targeted for replacement when a certain item, particularly, an item affecting the fuel consumption, is replaced, but also capable of changing such settings with ease.

Means for Solving the Problem (1) In accomplishing the above object, according to an aspect of the present invention, there is provided a control system for a construction machine having a plurality of items including an engine, a hydraulic pump driven by the engine, an actuator driven by a hydraulic fluid discharged from the hydraulic pump, and a member driven by the actuator, at least one of the items being selectively changeable from one item state to another. The control system includes item state selection means and engine revolution speed/pump torque setting change means. The item state selection means selects one of the plurality of item states. The engine revolution speed/pump torque setting change means changes the setting of an engine revolution speed and the setting of a pump torque in accordance with the item state selected by the item state selection means.

(2) There is provided the control system as described in above (1), wherein the item that is selectively changeable from one item state to another is an item affecting the fuel consumption of the construction machine.

When control based on a standard model is exercised in a situation where the speed of the actuator is decreased by item replacement, the engine revolution speed and the pump torque are changed in such a manner as to increase an engine output. This makes it possible to maintain the operability equivalent to that of the standard model.

When control based on a standard model is exercised in a situation where the speed of the actuator is increased by item replacement, the engine revolution speed and the pump torque are changed in such a manner as to reduce the engine output. This makes it possible to provide improved fuel efficiency while maintaining the operability equivalent to that of the standard model.

(3) There is provided the control system as described in above (2), wherein the item affecting the fuel consumption of the construction machine is an item affecting the weight of a vehicle body.

(4) There is provided the control system as described in above (2), wherein the item affecting the fuel consumption of the construction machine is an item affecting the fluid resistance of the hydraulic fluid.

(5) There is provided the control system as described in above (4), wherein the item affecting the fluid resistance of the hydraulic fluid is the hydraulic fluid.

(6) There is provided the control system as described in above (4), wherein the item affecting the fluid resistance of the hydraulic fluid is a hydraulic fluid conduit.

The present invention can also be applied to a situation where a hydraulic fluid, a conduit, or other item that has not frequently been replaced is replaced.

(7) There is provided the control system as described in above (1), wherein the item state selection means includes a display screen of a monitor device.

Consequently, the aforementioned settings can be changed with ease simply by selecting a target item while viewing the display screen of the monitor device.

(8) There is provided the control system as described in above (1), wherein the engine revolution speed/pump torque setting change means defines the upper and lower limits for an increase and decrease in the engine revolution speed and in the pump torque and changes the setting of the engine revolution speed and the setting of the pump torque within the range between the upper and lower limits.

Consequently, it is possible to suppress the excessive deterioration of operability and the excessive degradation of fuel efficiency.

Effects of the Invention

The present invention makes it possible to provide improved fuel efficiency without sacrificing the operability of a construction machine by changing the setting of an engine revolution speed and the setting of a pump torque in accordance with an item targeted for replacement when a certain item, particularly, an item affecting the fuel consumption, is replaced. The present invention also makes it possible to change such settings with ease.

BRIEF DESCRIPTION OF THE DRAWINGS

FIG. 11 shows an example of an engine revolution speed/pump torque setting change table.

MODE FOR CARRYING OUT THE INVENTION

First Embodiment

A first embodiment of the present invention will now be described with reference to the accompanying drawings.

Configuration

Figure 1:
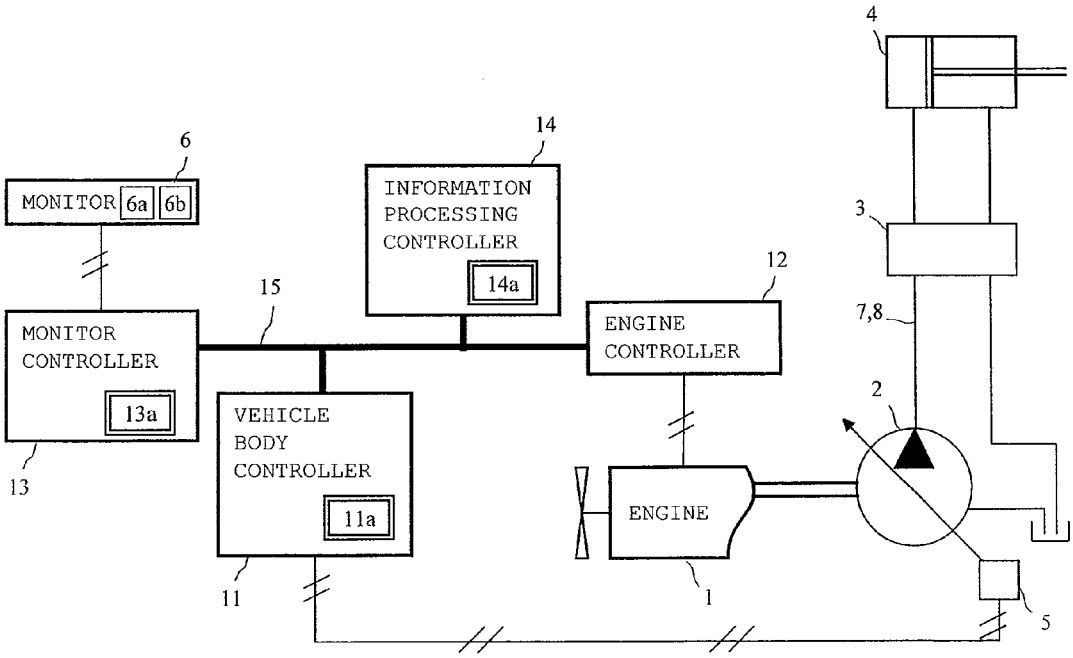
FIG. 1 is a diagram illustrating the overall configuration of a control system.

FIG. 1 is a diagram illustrating the overall configuration of a control system according to the first embodiment of the present invention.

A construction machine, such as a hydraulic excavator, includes an engine 1, a hydraulic pump 2, and an actuator 4. An output shaft of the engine 1 is connected to the hydraulic pump 2. The hydraulic pump 2 is rotationally driven by the engine 1. A valve device 3 is connected to a discharge path (conduit 7) of the hydraulic pump 2. A hydraulic fluid 8 is supplied to the actuator 4 through the valve device to drive the actuator 4. The hydraulic pump 2 includes a regulator 5 that controls the tilting (the tilting amount of a swash plate or the like, that is, the displacement volume or capacity) of the hydraulic pump 2 in accordance with the discharge pressure of the hydraulic pump 2 in order to prevent the torque consumed by the hydraulic pump 2 from exceeding its maximum absorption torque.

The control system controls the revolution speed of the engine 1, the torque of the engine, and the hydraulic pump 2. The control system includes, for example, a vehicle body controller 11, an engine controller 12, a monitor controller 13, and an information processing controller 14. These controllers are interconnected through a communication line 15 to form a vehicle body network.

The vehicle body controller 11 provides overall control of the vehicle body, including the control of a hydraulic drive system. For example, the vehicle body controller 11 controls the discharge pressure and discharge flow rate of the hydraulic pump 2 by controlling the regulator 5 of the hydraulic pump 2.

The engine controller 12 inputs a revolution speed command signal of an engine control dial. In accordance with the revolution speed command signal and with an actual revolution speed detection signal from a revolution speed sensor, the engine controller 12 controls the revolution speed of the engine 1 and the engine torque. Separately from this control, the engine controller 12 controls the revolution speed as needed.

The monitor controller 13 inputs various signals and various arithmetic processing results through the communication line 15 and sends a display signal to a monitor device 6, thereby causing a display screen 6*a* to display information included in the input signals. The monitor controller 13 also inputs a command signal generated from an operating switch 6*b*, which acts as a user interface.

The information processing controller 14 collects and records information transmitted from the vehicle body controller 11, the engine controller 12, the monitor controller 13, and various sensors (not shown).

Figure 2:
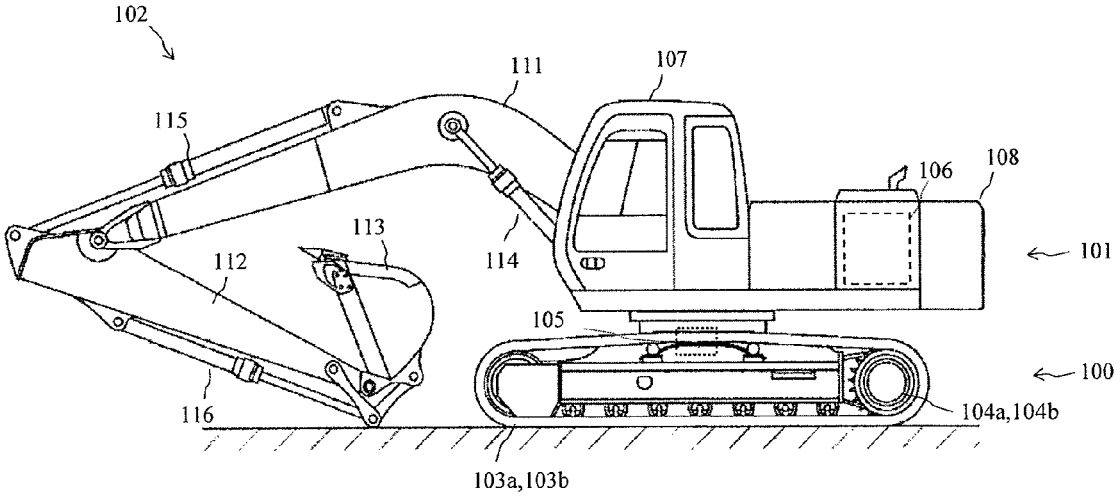
FIG. 2 is an external view of a hydraulic excavator.

FIG. 2 is an external view of a hydraulic excavator, which is an example of the construction machine. The hydraulic excavator includes a lower travel structure 100, an upper swing structure 101, and a front work device 102. The lower travel structure 100 includes left and right crawler travel devices 103*a*, 103*b* and is driven by left and right travel motors 104*a*, 104*b*. The upper swing structure 101 is swingably mounted on the lower travel structure 100 and driven by a swing motor 105. The front work device 102 is elevatably mounted on the front of the upper swing structure 101. The upper swing structure 101 includes an engine room 106, a cabin 107, and a counterweight 108. The engine 1 is disposed in the engine room 106.

The front work device 102 is an articulated structure having a boom 111, an arm 112, and a bucket 113. The boom 111 pivots in an up-down direction when a boom cylinder 114 expands or contracts. The arm 112 pivots in the up-down direction and in a front-rear direction when an arm cylinder 115 expands or contracts. The bucket 113 pivots in the up-down direction and in the front-rear direction when a bucket cylinder 116 expands or contracts.

The actuator 4 shown in FIG. 1 represents a plurality of actuators such as the swing motor 105, the arm cylinder 115, the boom cylinder 114, the bucket cylinder 116, and the travel motors 104*a*, 104*b*.

The construction machine may be a wheel loader or a wheel hydraulic excavator.

Figure 3:
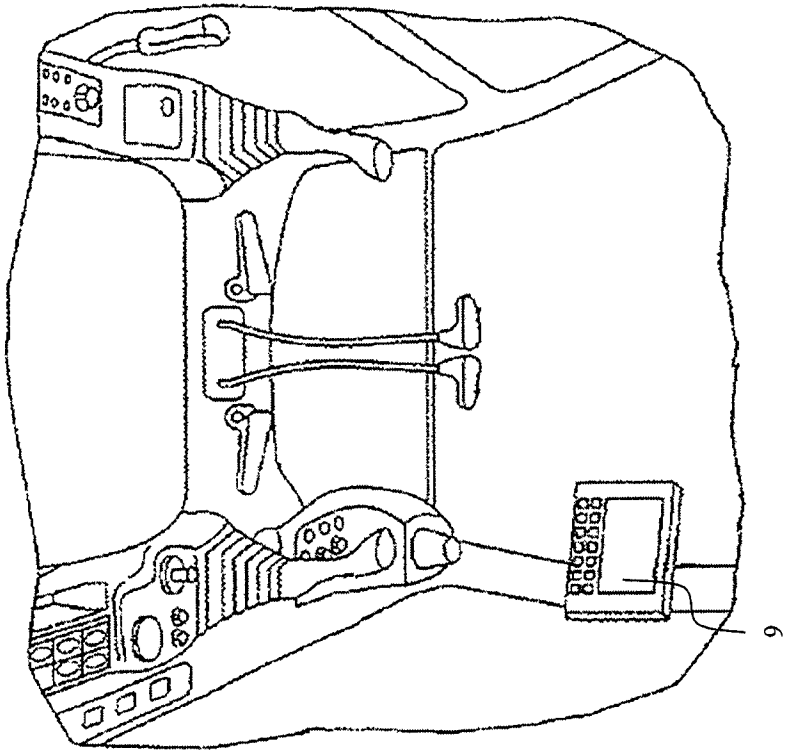
FIG. 3 is a partially enlarged perspective view illustrating the inside of a cabin 107.

FIG. 3 is a partially enlarged perspective view illustrating the inside of the cabin 107.

The monitor device 6 is disposed at such a position that it can easily be viewed by an operator in the cabin 107 of the hydraulic excavator. The monitor device 6 primary displays basic vehicle body information about the hydraulic excavator such as the remaining amount of fuel and the temperature of cooling water. The monitor device 6 includes the display screen 6*a* and the operating switch 6*b* and is controlled by the monitor controller 13. The operating switch 6*b* is disposed below the display screen 6*a*. When the operating switch 6*b* is manipulated, the monitor device 6 selectively displays vehicle body information including the basic vehicle body information. The display screen 6*a* and the operating switch 6*b* also function as an interface. More specifically, the operator can perform various setup operations concerning the vehicle body by manipulating the operating switch 6*b* while viewing the display screen 6*a*.

Figure 4:
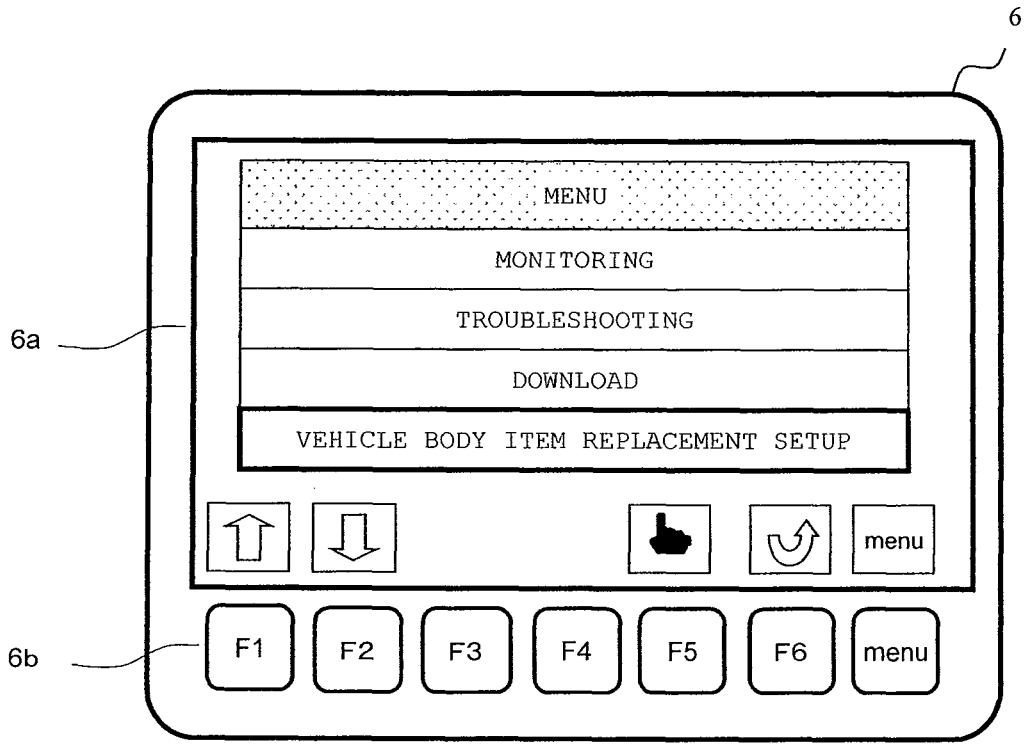
FIG. 4 shows an example of a menu screen.

FIG. 4 shows an example of a menu screen that appears on the display screen 6*a*. Pressing a menu key of the operating switch 6*b* causes the display screen 6*a* to switch from a basic vehicle body information screen (not shown) to the menu screen. The menu screen shows a plurality of menu options, namely, monitoring, troubleshooting, vehicle body information download, and vehicle body item replacement setup. "Down", "Up" "Decision" (finger), "Return", and "Menu" icons are respectively displayed at positions corresponding to the F1 key, F2 key, F5 key, F6 key, and menu key of the operating switch 6*b*. The options on the menu screen can be selected by moving a cursor (a thick outline in the figure) up or down and pressing the "Decision" key. The description of the options for monitoring, troubleshooting, and vehicle body information download is omitted.

Returning to FIG. 1, the characteristic configuration of the present embodiment will be described.

The vehicle body controller 11 includes an engine revolution speed/pump torque setting change function section 11*a* as one of its functions. The monitor controller 13 includes an item selection screen/item state selection screen display function section 13*a* as one of its functions. The information processing controller 14 stores an engine revolution speed/pump torque setting change table 14*a* as one item of information.

Figure 5:
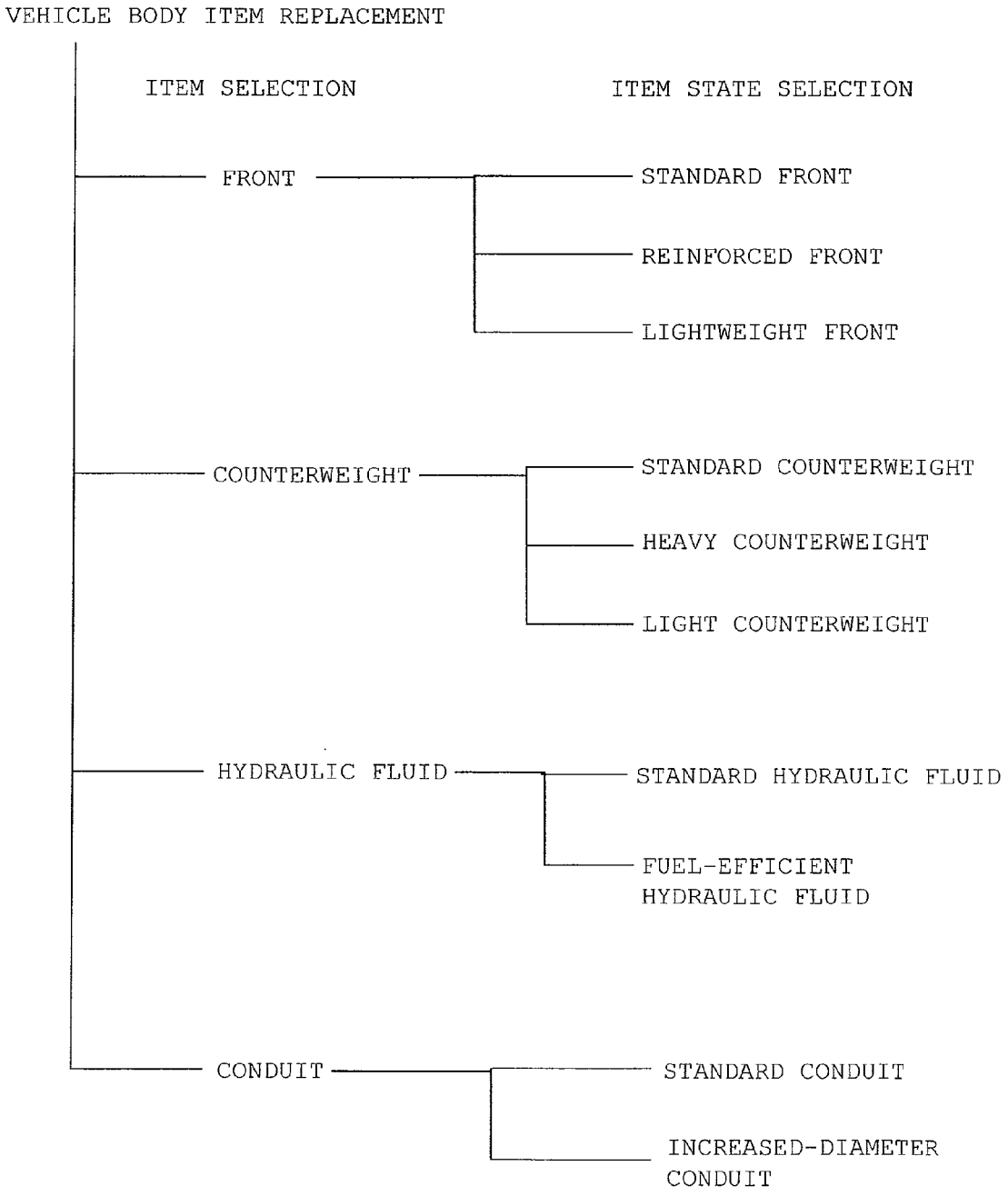
FIG. 5 is a conceptual diagram illustrating the tree structure of screens.

FIG. 5 is a conceptual diagram illustrating the tree structure of screens that are displayed on the display screen 6*a* by the item selection screen/item state selection screen display function section 13*a*. The item selection screen/item state selection screen display function section 13*a* displays an item selection screen (see FIG. 6), a front state selection screen (see FIG. 7), a counterweight state selection screen (see FIG. 8), a hydraulic fluid state selection screen (see FIG. 9), and a conduit state selection screen (see FIG. 10).

Figure 6:
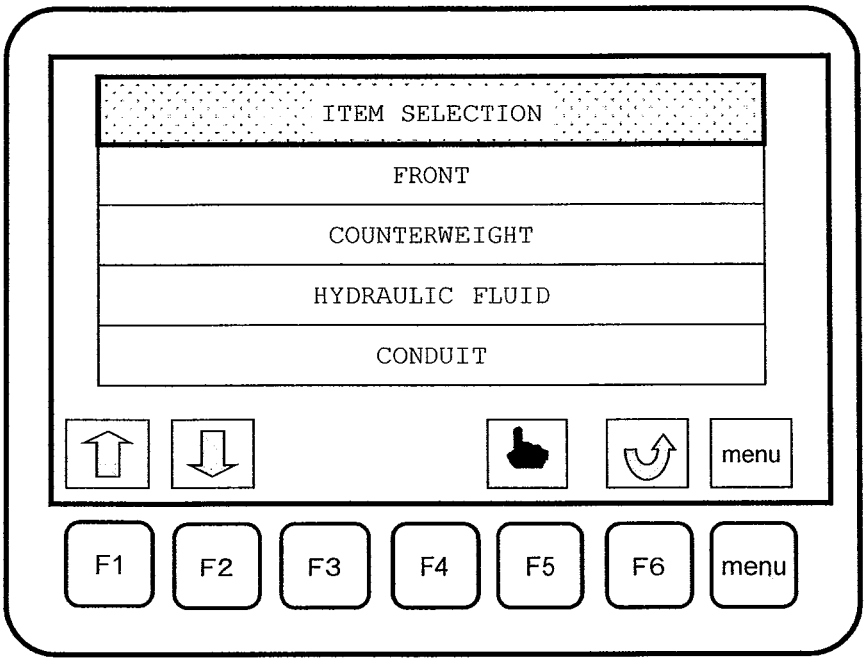
FIG. 6 shows an example of an item selection screen.

FIG. 6 shows an example of the item selection screen, which appears on the display screen 6*a*. When the vehicle body item replacement setup is selected from the menu screen (see FIG. 4), the display screen 6*a* switches to the item selection screen. The item selection screen shows a plurality of options, namely, front, counterweight, hydraulic fluid, and conduit. When a certain option is selected, the associated item is selected.

Figure 7:
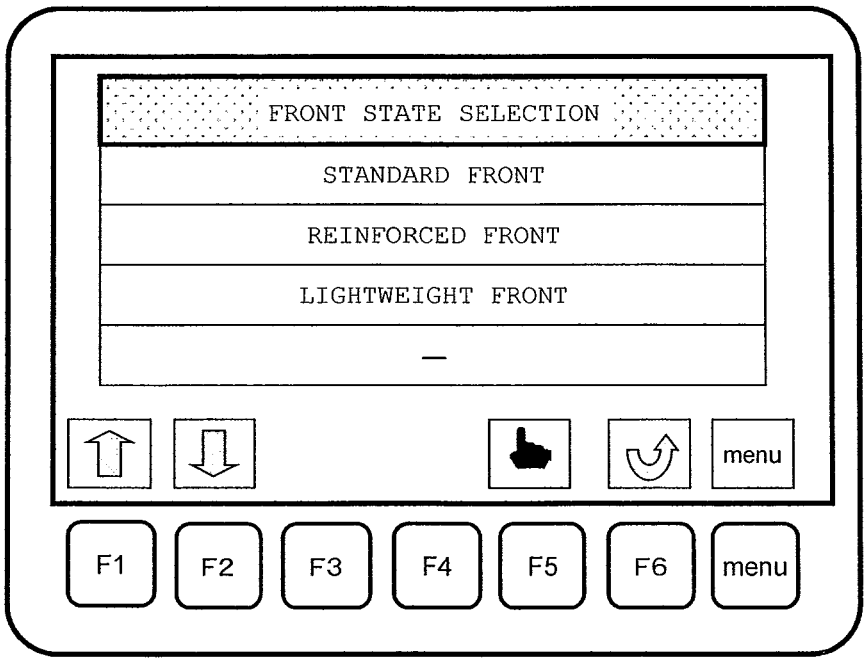
FIG. 7 shows an example of a front state selection screen.

FIG. 7 shows an example of the front state selection screen. When the front is chosen as a selected option from the item selection screen (see FIG. 6), the display screen 6*a* switches to the front state selection screen. The front state selection screen shows a plurality of options, namely, standard front, reinforced front, lightweight front.

Figure 8:
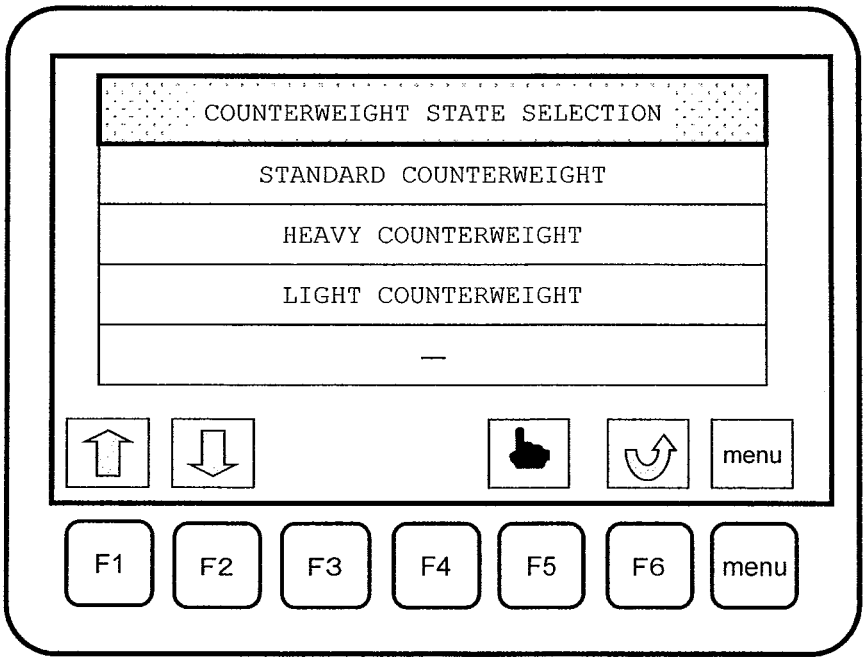
FIG. 8 shows an example of a counterweight state selection screen.

FIG. 8 shows an example of the counterweight state selection screen. When the counterweight is chosen as a selected option from the item selection screen (see FIG. 6), the display screen 6*a* switches to the counterweight state selection screen. The counterweight state selection screen shows a plurality of options, namely, standard counterweight, heavy counterweight, and light counterweight.

Figure 9:
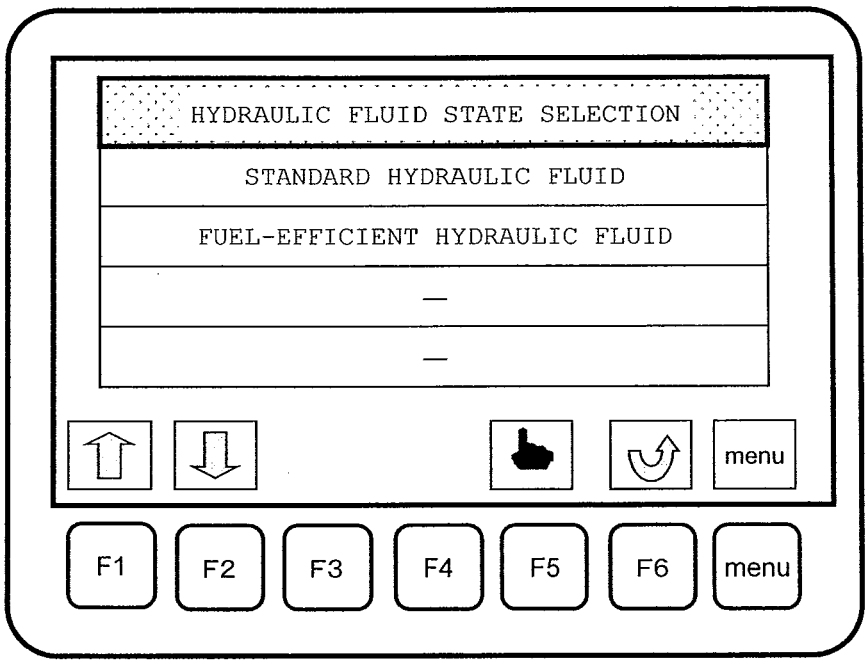
FIG. 9 shows an example of a hydraulic fluid state selection screen.

FIG. 9 shows an example of the hydraulic fluid state selection screen. When the hydraulic fluid is chosen as a selected option from the item selection screen (see FIG. 6), the display screen 6*a* switches to the hydraulic fluid state selection screen. The hydraulic fluid state selection screen shows a plurality of options, namely, standard hydraulic fluid and fuel-efficient hydraulic fluid.

Figure 10:
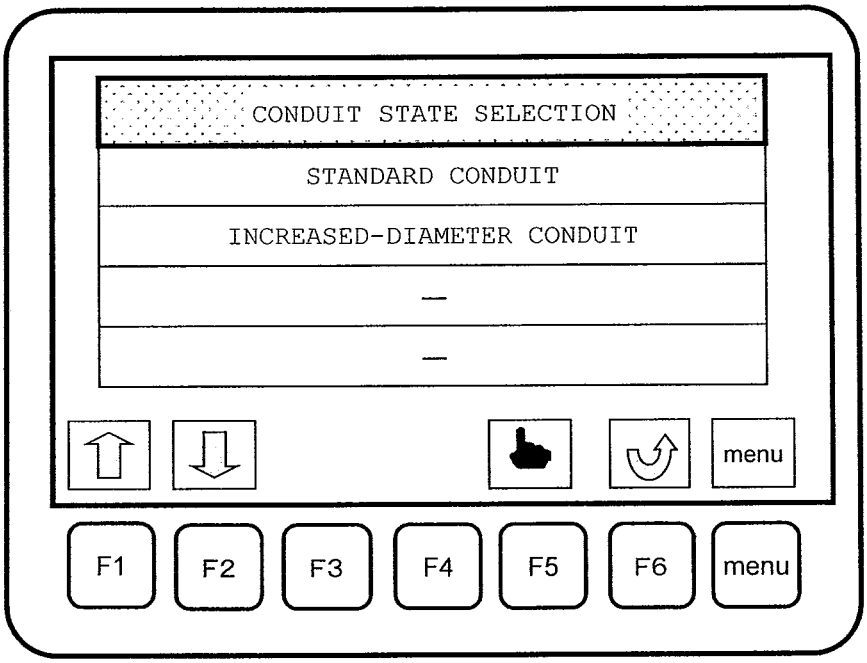
FIG. 10 shows an example of a conduit state selection screen.

FIG. 10 shows an example of the conduit state selection screen. When the conduit is chosen as a selected option from the item selection screen (see FIG. 6), the display screen 6*a* switches to the piping state selection screen. The conduit state selection screen shows a plurality of options, namely, standard conduit and increased-diameter conduit.

When specific options are selected from the item state selection screens (see FIGS. 7 to 10), an item state is selected.

FIG. 11 shows an example of the engine revolution speed/pump torque setting change table 14*a*. This table is organized with respect to various selected items and various selected item states in order to show how the engine revolution speed and the pump torque will be increased or decreased from their standard values (details will be given later).

Main functions of the engine revolution speed/pump torque setting change function section 11*a* will now be described with reference to FIGS. 12 and 13.

Figure 12:
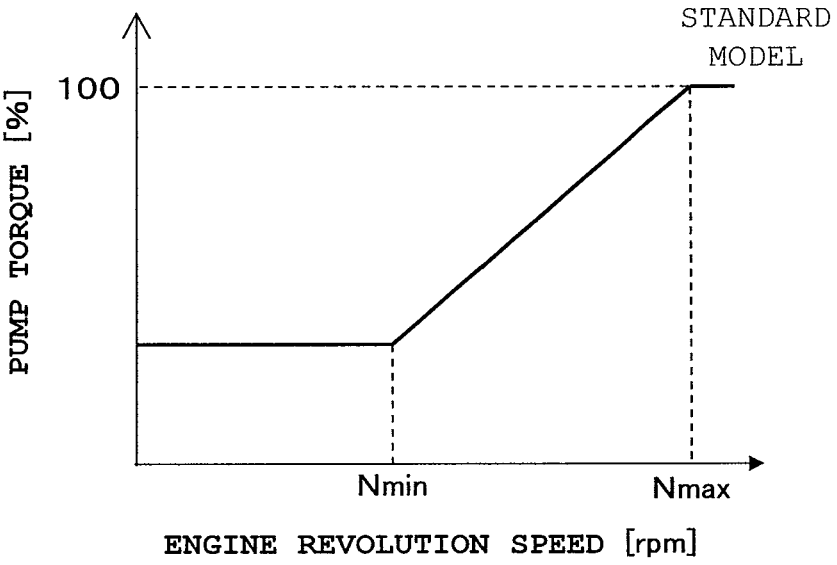
FIG. 12 is a diagram illustrating an exemplary relationship between the engine revolution speed and pump torque of a standard model.

FIG. 12 is a diagram illustrating an exemplary relationship between the engine revolution speed and pump torque that shows when all items, namely, the front, counterweight, hydraulic fluid, and conduit, are in their standard states (standard front, standard counterweight, standard hydraulic fluid, and standard conduit). When the engine revolution speed is lower than Nmin, a minimum pump torque is maintained. When the engine revolution speed is not lower than Nmin, the pump torque increases with an increase in the engine revolution speed. When the engine revolution speed is not lower than Nmax, a maximum pump torque is maintained. FIG. 12 indicates that the value of the maximum pump torque is 100%.

A case where the hydraulic fluid is changed from a standard hydraulic fluid to a fuel-efficient hydraulic fluid will now be described as an example. The engine revolution speed/pump torque setting change function section 11*a* accesses a portion of the engine revolution speed/pump torque setting change table 14*a* that relates to a selected item (hydraulic fluid) and a selected item state (fuel-efficient hydraulic fluid), reads an engine revolution speed increase/decrease (−50 rpm) from the standard value and a pump torque increase/decrease (−5%) from the standard value, and changes the setting of the engine revolution speed and the setting of the pump torque.

Figure 13:
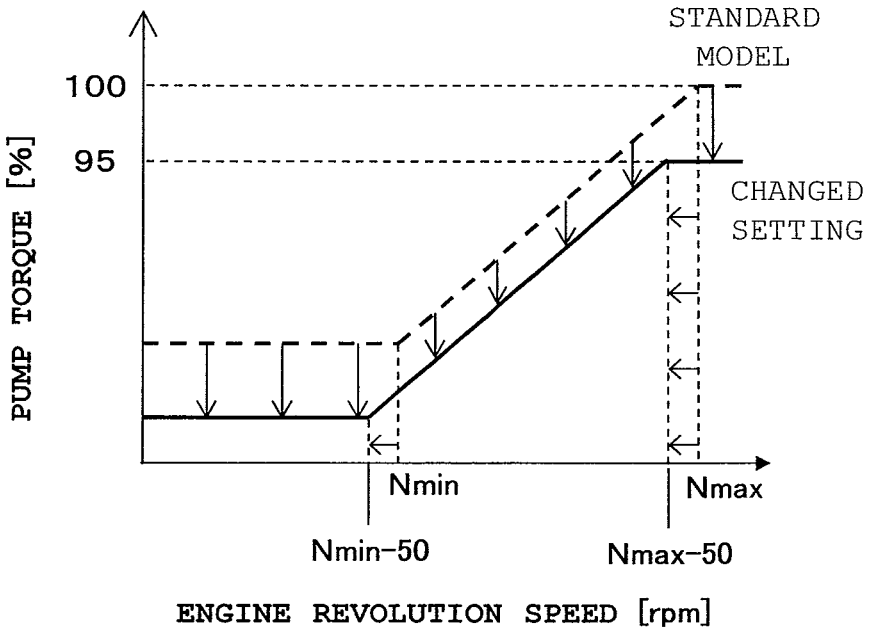
FIG. 13 is a diagram illustrating an exemplary relationship between the engine revolution speed and pump torque that prevails after setting changes.

FIG. 13 is a diagram illustrating an exemplary relationship between the engine revolution speed and pump torque that prevails after setting changes. The broken line indicative of the standard state, which is shown in FIG. 13, is shifted downward until the pump torque is decreased by 5%. Further, the minimum engine revolution speed Nmin and the maximum engine revolution speed Nmax are shifted leftward until they are decreased by 50 rpm.

For brevity of explanation, this document assumes that the shift from the broken line in FIG. 13 to the solid line in the same figure is indicated by an engine speed decrease of 50 rpm and a pump torque decrease of 5%. A change made to shift the broken line indicative of the standard state downward until the pump torque is decreased by δ×% and shift the minimum and maximum engine revolution speeds Nmin, Nmax leftward until they are decreased by δN rpm is hereinafter indicated by an engine revolution speed decrease of δN rpm and a pump torque decrease of δ×%. Further, a change made to shift the broken line indicative of the standard state upward until the pump torque is increased by δ×% and shift the minimum and maximum engine revolution speeds Nmin, Nmax rightward until they are increased by δN rpm is hereinafter indicated by an engine revolution speed increase of δN rpm and a pump torque increase of δ×%.

The above-described example assumes that only the hydraulic fluid is replaced. If a plurality of items are replaced, the engine revolution speed/pump torque setting change function section 11*a* adds up the amounts of increase and decrease. If, for instance, the front is changed from a standard front to a reinforced front and the counterweight is changed from a standard counterweight to a heavy counterweight, the engine revolution speed/pump torque setting change function section 11*a* accesses a portion of the engine revolution speed/pump torque setting change table 14*a* that relates to a selected item (front) and a selected item state (reinforced front), reads an engine revolution speed increase/decrease (+50 rpm) from the standard value and a pump torque increase/decrease (+5%) from the standard value, accesses a portion of the engine revolution speed/pump torque setting change table 14*a* that relates to another selected item (counterweight) and another selected item state (heavy counterweight), reads an engine revolution speed increase/decrease (+50 rpm) from the standard value and a pump torque increase/decrease (+5%) from the standard value, adds up the read values, and makes changes by increasing the engine revolution speed by 100 rpm and increasing the pump torque by 10%.

Correspondence to Claims

The display screen 6*a* and the operating switch 6*b*, which are included in the monitor device 6, the item selection screen/item state selection screen display function section 13*a*, and the screens shown in FIGS. 6 to 10 constitute item state selection means for selecting one of a plurality of item states.

The engine revolution speed/pump torque setting change table 14*a* and the engine revolution speed/pump torque setting change function section 11*a* constitute engine revolution speed/pump torque setting change means for changing the setting of the engine revolution speed and the setting of the pump torque in accordance with a selected item state.

Operations

A standard model (a model in which all items, namely, the front, counterweight, hydraulic fluid, and conduit, are in a standard state) of the hydraulic excavator is manufactured at a factory. However, when the hydraulic excavator is to be shipped out of the factory, a manufacturer's service technician replaces some items and changes some item states as needed to comply with a request of a customer and changes the settings of the engine revolution speed and pump torque in accordance with item replacements and item state changes.

Further, in recent years, it is frequent that a leasing company purchases a large number of construction machines and leases them to a construction company or other customer. When purchasing the hydraulic excavator, the leasing company generally purchases its standard model. Meanwhile, a service technician of the leasing company replaces some items and changes some item states as needed to comply with a request of the customer and changes the settings of the engine revolution speed and pump torque in accordance with item replacements and item state changes.

The service technician selects the vehicle body item replacement setup from the menu screen (see FIG. 4) to let the monitor device 6 display the item selection screen (see FIG. 6). Next, the service technician selects a displayed option corresponding to a replaced item to open an item state selection screen (see FIGS. 7 to 10), and selects an appropriate displayed item state.

A case where the front is changed from the standard front to the reinforced front will now be described. As the reinforced front is heavier than the standard front, the operability of the hydraulic excavator deteriorates (e.g., the speed of boom raising decreases) when control based on the standard model is exercised.

When the service technician selects a displayed item state (reinforced front), the engine revolution speed increases by 50 rpm and the pump torque increases by 5% (refer to the description given with reference to FIG. 13 for the expressions of changes). This increases an engine output. Consequently, the operability equivalent to that of the standard model can be maintained even when the front is changed from the standard front to the reinforced front.

A case where the front is changed from the standard front to the lightweight front will now be described. As the lightweight front is lighter than the standard front, for example, the speed of boom raising increases when control based on the standard model is exercised. However, the speed need not be increased beyond the speed of the standard model. Instead, it is preferred that improved fuel efficiency be provided.

When the service technician selects a displayed item state (lightweight front), the engine revolution speed decreases by 50 rpm and the pump torque decreases by 5%. This reduces the engine output. Consequently, when the front is changed from the standard front to the lightweight front, the fuel efficiency can be improved while maintaining the operability equivalent to that of the standard model.

A case where the counterweight is changed from the standard counterweight to the heavy counterweight will now be described. As the heavy counterweight is heavier than the standard counterweight, the operability deteriorates (e.g., the speed of swinging decreases) when control based on the standard model is exercised.

When the service technician selects a displayed item state (heavy counterweight), the engine revolution speed increases by 50 rpm and the pump torque increases by 5%. This increases the engine output. Consequently, the operability equivalent to that of the standard model can be maintained even when the counterweight is changed from the standard counterweight to the heavy counterweight.

A case where the counterweight is changed from the standard counterweight to the light counterweight will now be described. As the light counterweight is lighter than the standard counterweight, for example, the speed of swinging increases when control based on the standard model is exercised. However, the speed need not be increased beyond the speed of the standard model. Instead, it is preferred that improved fuel efficiency be provided.

When the service technician selects a displayed item state (light counterweight), the engine revolution speed decreases by 50 rpm and the pump torque decreases by 5%. This reduces the engine output. Consequently, when the counterweight is changed from the standard counterweight to the light counterweight, the fuel efficiency can be improved while maintaining the operability equivalent to that of the standard model.

A case where the hydraulic fluid is changed from the standard hydraulic fluid to the fuel-efficient hydraulic fluid will now be described. As the fuel-efficient hydraulic fluid has a lower viscosity than the standard hydraulic fluid, a pressure loss decreases. Therefore, when control based on the standard model is exercised, the speeds of various actuators increase. However, the speed need not be increased beyond the speed of the standard model. Instead, it is preferred that improved fuel efficiency be provided.

When the service technician selects a displayed item state (fuel-efficient hydraulic fluid), the engine revolution speed decreases by 50 rpm and the pump torque decreases by 5%. This reduces the engine output. Consequently, when the hydraulic fluid is changed from the standard hydraulic fluid to the fuel-efficient hydraulic fluid, the fuel efficiency can be improved while maintaining the operability equivalent to that of the standard model.

A case where the conduit is changed from the standard conduit to the increased-diameter conduit will now be described. As the increased-diameter conduit has a larger cross-sectional area than the standard conduit, the pressure loss decreases. Therefore, when control based on the standard model is exercised, the speeds of various actuators increase. However, the speeds need not be increased beyond the speeds of the standard model. Instead, it is preferred that improved fuel efficiency be provided.

When the service technician selects a displayed item state (increased-diameter conduit), the engine revolution speed decreases by 50 rpm and the pump torque decreases by 5%. This reduces the engine output. Consequently, when the conduit is changed from the standard conduit to the increased-diameter conduit, the fuel efficiency can be improved while maintaining the operability equivalent to that of the standard model.

Cases where the state of a certain item is changed from the standard model (in which all items are in the standard state) have been described above. The same holds true when an item is replaced to revert to the standard state. The service technician selects the vehicle body item replacement setup from the menu screen (see FIG. 4) to let the monitor device 6 display the item selection screen (see FIG. 6). Next, the service technician selects a displayed option corresponding to the replaced item to open an item state selection screen (see FIGS. 7 to 10), and selects a displayed item state in the standard state (e.g., the standard front). This ensures that control based on the standard model is exercised.

Effects

As described above, when control based on the standard model is exercised in a situation where the speed of an actuator is decreased by item replacement, the present embodiment changes the engine revolution speed and the pump torque in such a manner as to increase the engine output. This makes it possible to maintain the operability equivalent to that of the standard model.

When control based on the standard model is exercised in a situation where the speed of the actuator is increased by item replacement, the present embodiment changes the engine revolution speed and the pump torque in such a manner as to reduce the engine output. This makes it possible to provide improved fuel efficiency while maintaining the operability equivalent to that of the standard model.

The service technician can make the above-described setting changes with ease simply by selecting relevant options while viewing the monitor device 6.

Second Embodiment

A second embodiment is obtained by adding some characteristic functions to the engine revolution speed/pump torque setting change function section 11*a* according to the first embodiment.

Item State Addition

A new item (item state) may be developed in addition to the items (item states) existing at the time of manufacture of the hydraulic excavator. When the standard state is to be changed to a new item state, it is necessary to change the settings of the engine revolution speed and pump torque in accordance with the new item state. A case where a second lightweight front, which is lighter than the lightweight front, is developed will now be described as an example.

Figure 14:
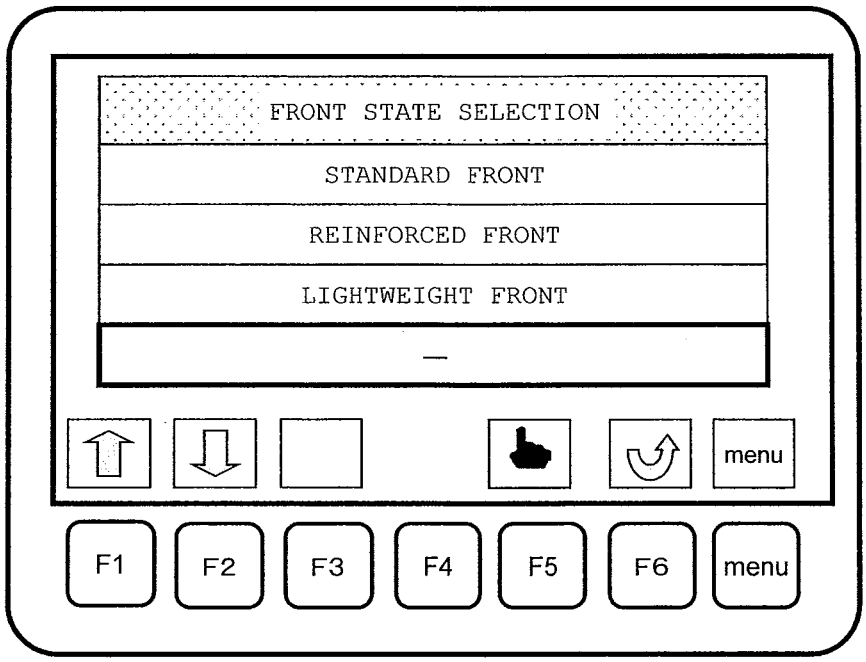
FIG. 14 shows the front state selection screen for the addition of an item state.
Figure 15:
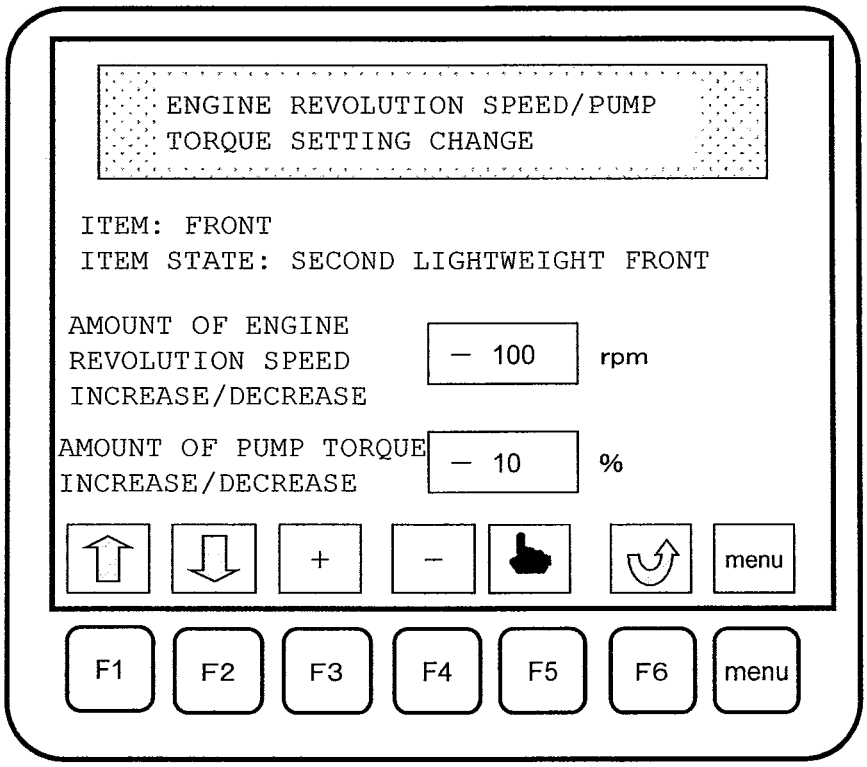
FIG. 15 shows an engine revolution speed/pump torque setting change screen for the addition of an item state.

FIG. 14 shows the front state selection screen for the addition of an item state. FIG. 15 shows an engine revolution speed/pump torque setting change screen for the addition of an item state.

The service technician selects the vehicle body item replacement setup from the menu screen (see FIG. 4) to let the monitor device 6 display the item selection screen (see FIG. 6). Next, the service technician selects a displayed option (front) to open the front state selection screen (see FIG. 7).

When the service technician moves the cursor downward to a blank field in the front state selection screen, an "Add" icon appears at a position corresponding to the F3 key of the operating switch 6*b* at the bottom of the screen (see FIG. 14). The service technician adds an item state (second lightweight front) to the blank field.

Further, the service technician selects the added item state (second lightweight front) to open the engine revolution speed/pump torque setting change screen. As the second lightweight front is lighter than the lightweight front, it can be expected that the fuel efficiency will further improve when the engine output is further reduced. For example, the service technician manipulates the operating switch 6*b* (e.g., the F3 and F4 keys corresponding respectively to the "+" and "−" icons) to set an engine revolution speed increase/decrease (−100 rpm) from a standard value and a pump torque increase/decrease (−10%) from a standard value (see FIG. 15).

The engine revolution speed/pump torque setting change function section 11*a* adds the engine revolution speed increase/decrease (−100 rpm) from the standard value and the pump torque increase/decrease (−10%) from the standard value to the engine revolution speed/pump torque setting change table 14*a* in accordance with the selected item (front) and with the selected item state (second lightweight front).

As described above, even when a new item (item state) is developed, the setting changes can be made with ease to reflect item state characteristics (e.g., the second lightweight front is lighter than the lightweight front).

Once a new item state is added, the subsequent operations to be performed are the same as those described in conjunction with the first embodiment.

Item Addition

In the first embodiment, a plurality of item states can be selected to make changes, and the front, counterweight, hydraulic fluid, and conduit are exemplified as the items affecting the fuel consumption. However, the present invention is not limited to such an embodiment. Items can be added in accordance with the judgment of the customer or of the service technician. A case where an attachment is to be added as an item and a bucket (standard state) and a breaker are added as attachment states will now be described as an example.

Figure 16:
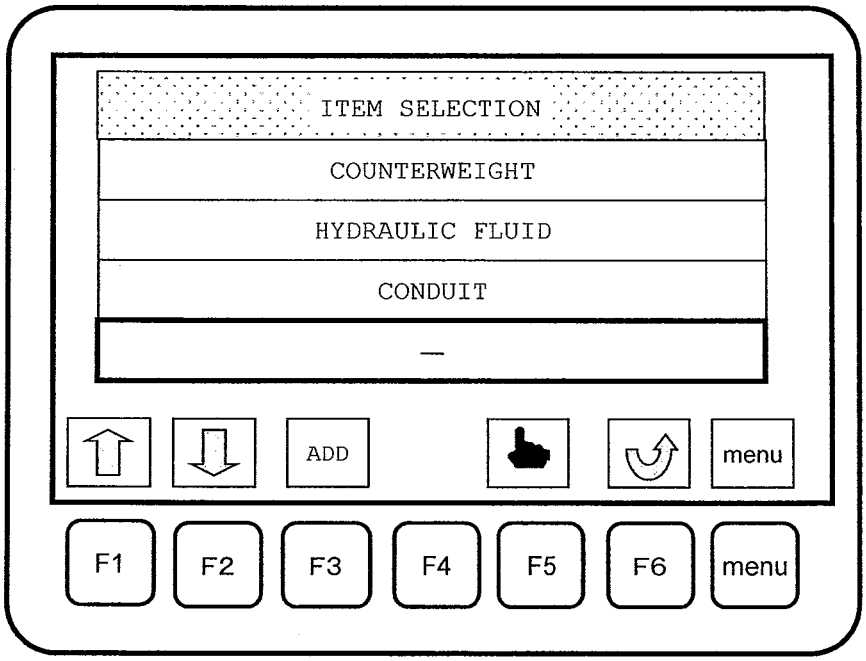
FIG. 16 shows the item selection screen for the addition of an item.
Figure 17:
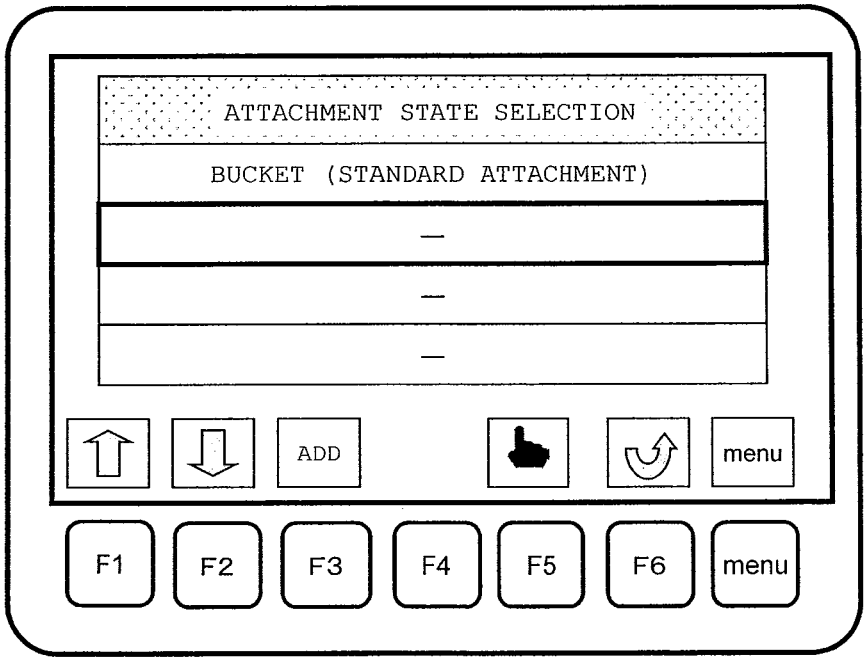
FIG. 17 shows an attachment state selection screen for the addition of an item.
Figure 18:
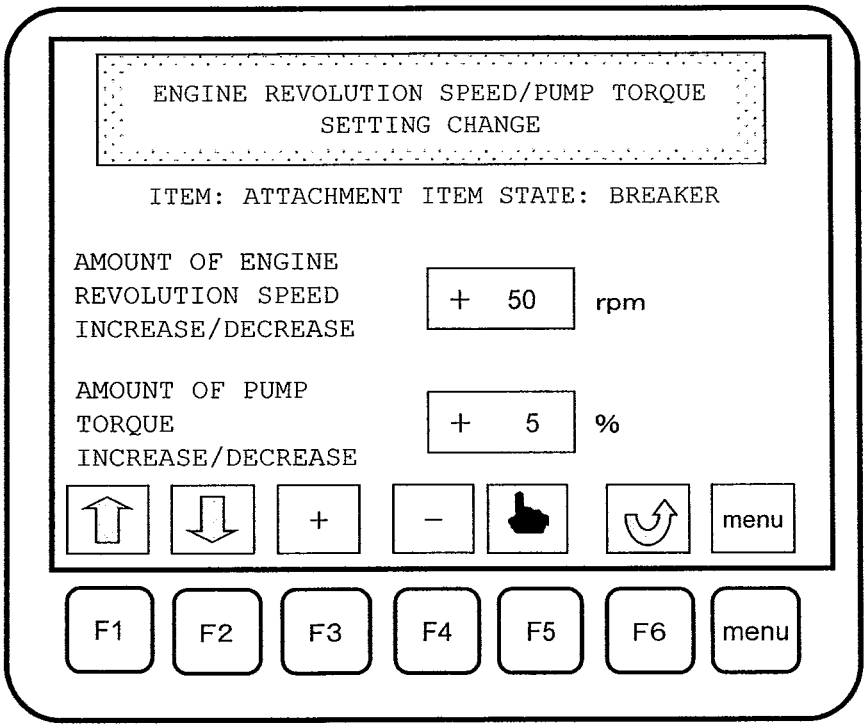
FIG. 18 shows the engine revolution speed/pump torque setting change screen for the addition of an item.

FIG. 16 shows the item selection screen for the addition of an item. FIG. 17 shows an attachment state selection screen for the addition of an item. FIG. 18 shows the engine revolution speed/pump torque setting change screen for the addition of an item.

The service technician selects the vehicle body item replacement setup from the menu screen (see FIG. 4) to let the monitor device 6 display the item selection screen (see FIG. 6). When the service technician moves the cursor downward to a blank field in the item selection screen, the "Add" icon appears at a position corresponding to the F3 key of the operating switch 6*b* at the bottom of the screen (see FIG. 16). The service technician adds an item (attachment) to the blank field.

Further, the service technician selects the added item (attachment) to open the attachment state selection screen (see FIG. 17). The service technician sets a bucket as the standard state of the attachment. The subsequent operations are the same as those described in conjunction with the addition of an item state.

More specifically, the service technician moves the cursor downward to a blank field in the attachment state selection screen and adds an item state (breaker) to the blank field.

Further, the service technician selects the added item state (breaker) to open the engine revolution speed/pump torque setting change screen. When the bucket is to be replaced by the breaker, setup needs to be performed so as to increase the engine output. For example, the service technician manipulates the operating switch 6*b* (the F3 and F4 keys corresponding respectively to the "+" and "−" icons) to set an engine revolution speed increase/decrease (+50 rpm) from a standard value and a pump torque increase/decrease (+5%) from a standard value (see FIG. 18).

The engine revolution speed/pump torque setting change function section 11*a* adds an engine revolution speed increase/decrease (±0 rpm) from the standard value and a pump torque increase/decrease (±0%) from the standard value to the engine revolution speed/pump torque setting change table 14*a* in relation to the selected item (attachment) and the selected item state (bucket (standard state)), and adds an engine revolution speed increase/decrease (+50 rpm) from the standard value and a pump torque increase/decrease (+5%) from the standard value to the engine revolution speed/pump torque setting change table 14*a* in relation to the selected item (attachment) and the selected item state (breaker).

As described above, even when a new item is to be added, relevant setting changes can be made with ease to reflect an item state and item state characteristics.

Once an item is added, the subsequent operations to be performed are the same as those described in conjunction with the first embodiment.

Deletion

Items and item states can be deleted as needed. A case where an added item (attachment) is to be deleted will now be described as an example.

Figure 19:
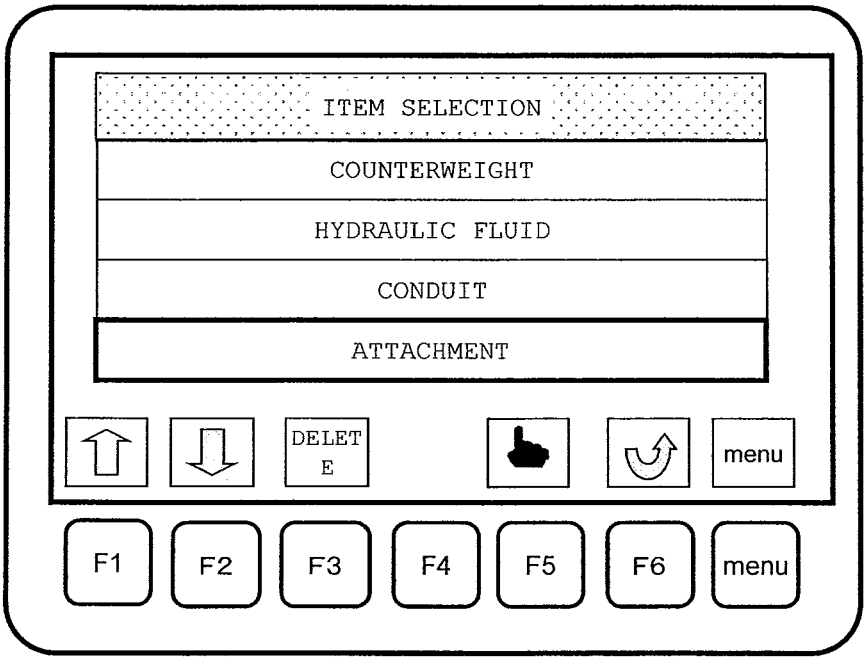
FIG. 19 shows the item selection screen for the deletion of an item.

FIG. 19 shows the item selection screen for the deletion of an item.

The service technician selects the vehicle body item replacement setup from the menu screen (see FIG. 4) to let the monitor device 6 display the item selection screen (see FIG. 6). When the service technician moves the cursor downward to a displayed item (attachment), a "Delete" icon appears at a position corresponding to the F3 key of the operating switch 6*b* at the bottom of the screen (see FIG. 19). The service technician manipulates the operating switch 6*b* to delete the displayed item (attachment).

The engine revolution speed/pump torque setting change function section 11*a* deletes an engine revolution speed increase/decrease (±0 rpm) from the standard value and a pump torque increase/decrease (±0%) from the standard value, which relate to the selected item (attachment) and the selected item state (bucket (standard state)), from the engine revolution speed/pump torque setting change table 14*a*, and deletes an engine revolution speed increase/decrease (+50 rpm) from the standard value and a pump torque increase/decrease (+5%) from the standard value, which relate to the selected item (attachment) and the selected item state (breaker), from the engine revolution speed/pump torque setting change table 14*a*.

Correction

Engine revolution speed and pump torque setting changes can be corrected as needed. A case where the engine revolution speed and pump torque setting changes for a selected breaker are to be corrected will now be described.

Figure 20:
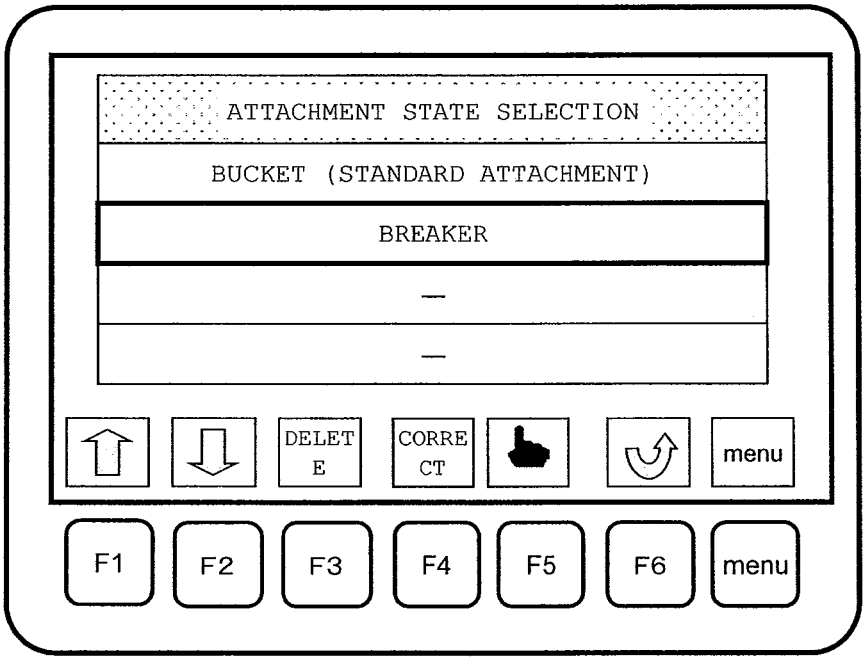
FIG. 20 shows the attachment state selection screen for the correction of setting changes.
Figure 21:
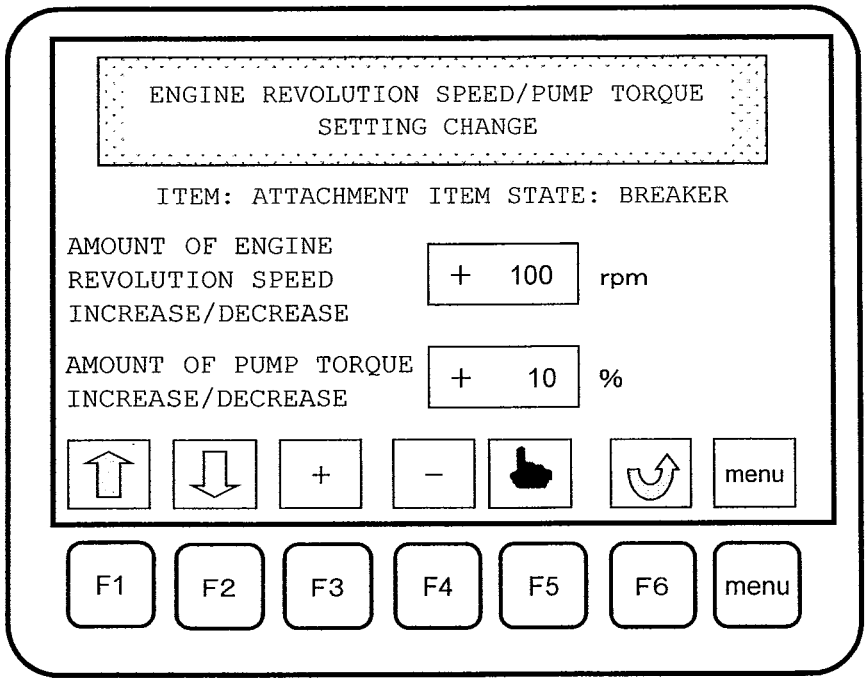
FIG. 21 shows the engine revolution speed/pump torque setting change screen for the correction of setting changes.

FIG. 20 shows the attachment state selection screen for the correction of setting changes. FIG. 21 shows the engine revolution speed/pump torque setting change screen for the correction of setting changes.

The service technician selects the vehicle body item replacement setup from the menu screen (see FIG. 4) to let the monitor device 6 display the item selection screen, selects a displayed item (attachment) (see FIG. 19) to open the attachment state selection screen. When the service technician moves the cursor downward to a displayed item state (breaker), the "Delete" icon and a "Correct" icon appear at positions corresponding respectively to the F3 and F4 keys of the operating switch 6*b* at the bottom of the screen (see FIG. 20). The service technician manipulates the operating switch 6*b* to open the engine revolution speed/pump torque setting change screen (see FIG. 18) for the purpose of correcting the displayed item state (breaker). This screen shows the previously selected engine revolution speed increase/decrease (+50 rpm) from the standard value and the previously selected pump torque increase/decrease (+5%) from the standard value.

If the operability of the breaker is poor at the previous settings, it is necessary to correct the settings in such a manner as to further increase the engine output. In such an instance, for example, the service technician manipulates the operating switch 6*b* to set an engine revolution speed increase/decrease (+100 rpm) from the standard value and a pump torque increase/decrease (+10%) from the standard value (see FIG. 21).

The engine revolution speed/pump torque setting change function section 11*a* makes a correction to switch from the engine revolution speed increase/decrease (+50 rpm) from the standard value and the pump torque increase/decrease (+5%) from the standard value, which relate to the previous settings (selected item (attachment) and selected item state (breaker)) in the engine revolution speed/pump torque setting change table 14*a*, to the engine revolution speed increase/decrease (+100 rpm) from the standard value and the pump torque increase/decrease (+10%) from the standard value.

Limitation

In the first embodiment, the engine revolution speed/pump torque setting change function section 11*a* adds up the amounts of increase and decrease when a plurality of items are replaced. If, for instance, the front is changed from the standard front to the lightweight front, the counterweight is changed from the standard counterweight to the light counterweight, the hydraulic fluid is changed from the standard hydraulic fluid to the fuel-efficient hydraulic fluid, and the conduit is changed from the standard conduit to the increased-diameter conduit, the engine revolution speed/pump torque setting change function section 11*a* reads the engine revolution speed increase/decrease (−50 rpm) from the standard value and the pump torque increase/decrease (−5%) from the standard value, which relate to the selected item (front) and the selected item state (lightweight front), reads the engine revolution speed increase/decrease (−50 rpm) from the standard value and the pump torque increase/decrease (−5%) from the standard value, which relate to the selected item (counterweight) and the selected item state (light counterweight), reads the engine revolution speed increase/decrease (−50 rpm) from the standard value and the pump torque increase/decrease (−5%) from the standard value, which relate to the selected item (hydraulic fluid) and the selected item state (fuel-efficient hydraulic fluid), reads the engine revolution speed increase/decrease (−50 rpm) from the standard value and the pump torque increase/decrease (−5%) from the standard value, which relate to the selected item (conduit) and the selected item state (increased-diameter conduit), from the engine revolution speed/pump torque setting change table 14*a*, adds up the read values, and makes changes by decreasing the engine revolution speed by 200 rpm and decreasing the pump torque by 20%.

However, if the engine output is excessively reduced as mentioned above, the operability may not be maintained. Meanwhile, if items are replaced to increase the engine output by making changes to increase the engine revolution speed by 200 rpm and increase the pump torque by 20%, the fuel efficiency may excessively degrade.

The above problem may be addressed by setting upper and lower limits to avoid an excessive increase or decrease in the engine revolution speed and in the pump torque.

Figure 22:
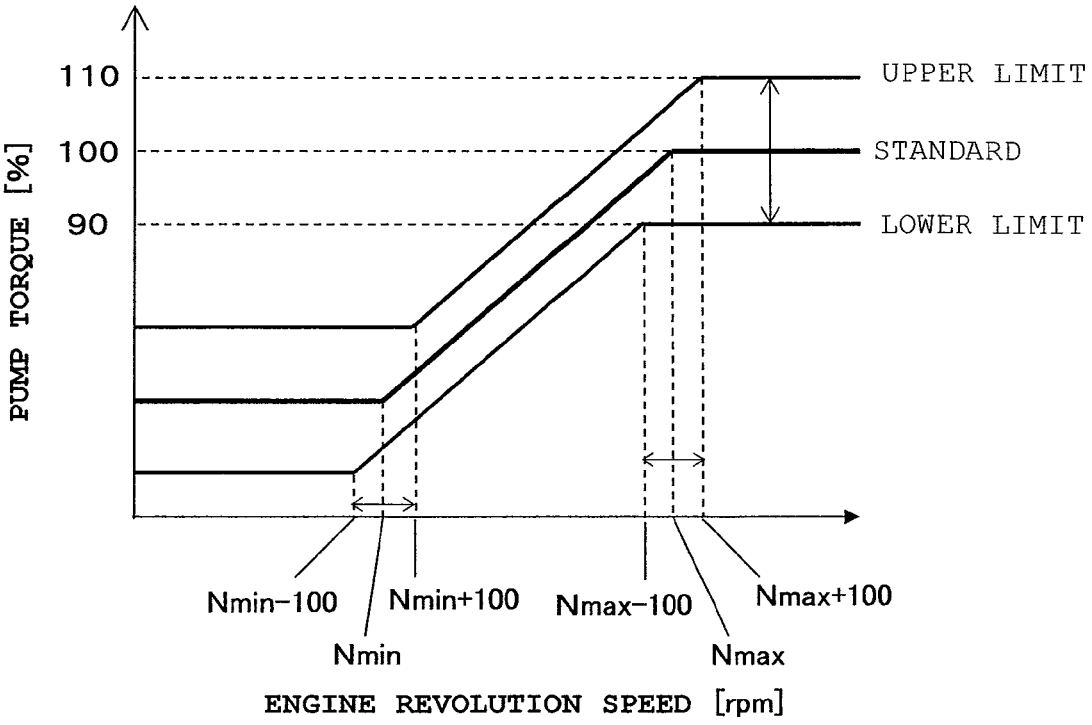
FIG. 22 is a diagram illustrating the upper and lower limits for an increase and decrease in the engine revolution speed and in the pump torque.

FIG. 22 is a diagram illustrating the upper and lower limits for an increase and decrease in the engine revolution speed and in the pump torque. This figure is to be read in the same manner as FIGS. 12 and 13. It is assumed, for example, that the upper limit represents an engine revolution speed increase of 100 rpm and a pump torque increase of 10%, and that the lower limit represents an engine revolution speed decrease of 100 rpm and a pump torque decrease of 10%.

For example, even if the sum of the amounts of increase and decrease indicates an engine revolution speed decrease of 200 rpm and a pump torque decrease of 20%, the engine revolution speed/pump torque setting change function section 11*a* makes changes so as to decrease the engine revolution speed by 100 rpm and decrease the pump torque by 10%. This makes it possible to avoid an excessive decrease in the engine output and maintain the operability.

On the other hand, even if, for example, the sum of the amounts of increase and decrease indicates an engine revolution speed increase of 200 rpm and a pump torque increase of 20%, the engine revolution speed/pump torque setting change function section 11*a* makes changes so as to increase the engine revolution speed by 100 rpm and increase the pump torque by 10%. This makes it possible to avoid an excessive increase in the engine output and suppress the degradation of fuel efficiency.

DESCRIPTION OF REFERENCE NUMERALS

1 . . . Diesel engine
2 . . . Hydraulic pump
3 . . . Valve device
4 . . . Actuator
5 . . . Regulator
6 . . . Monitor device
6*a* . . . Display screen
6*b* . . . Operating switch
7 . . . Conduit
8 . . . Hydraulic fluid
11 . . . Vehicle body controller
11*a* . . . Engine revolution speed/pump torque setting change function section
12 . . . Engine controller
13 . . . Monitor controller
13*a* . . . Item selection screen/item state selection screen display function section

14 . . . Information processing controller
14*a* . . . Engine revolution speed/pump torque setting change table
15 . . . Communication line
100 . . . Lower travel structure
101 . . . Upper swing structure
102 . . . Front work device
103*a*, 103*b* . . . Crawler travel device
104*a*, 104*b* . . . Travel motor
105 . . . Swing motor
106 . . . Engine room
107 . . . Cabin
111 . . . Boom
112 . . . Arm
113 . . . Bucket
114 . . . Boom cylinder
115 . . . Arm cylinder
116 . . . Bucket cylinder

The invention claimed is:

1. A control system for a construction machine having a plurality of items including an engine, a hydraulic pump driven by the engine, an actuator driven by a hydraulic fluid discharged from the hydraulic pump, and a member driven by the actuator, where at least two items of the plurality of items are each selectively changeable among a plurality of respective item states, the control system comprising:

an interface to respectively select one of the respective item states for each of the at least two items simultaneously; and a controller configured to set an engine revolution speed and a pump torque in accordance with the respective item states selected according to the interface, wherein, when the respective item states that have been selected for each of the at least two items have changed, the controller is further configured to set amounts of increase and decrease of the engine revolution speed and amounts of increase and decrease of the pump torque corresponding to the respective item states for the at least two items so that a sum of the increase and decrease of the engine revolution speed and a sum of the increase and decrease of the pump torque do not exceed a predefined upper limit and a predefined lower limit.

2. The control system according to claim 1, wherein the at least two items include items that affect fuel consumption of the construction machine.

3. The control system according to claim 2, wherein the at least two items include items that affect weight of a vehicle body.

4. The control system according to claim 2, wherein the at least two items include at least one item affecting fluid resistance of the hydraulic fluid.

5. The control system according to claim 4, wherein the at least one item affecting the fluid resistance of the hydraulic fluid is a type of hydraulic fluid.

6. The control system according to claim 4, wherein the at least one item affecting the fluid resistance of the hydraulic fluid is a hydraulic fluid conduit.

7. The control system according to claim 1, wherein the interface includes a monitor device and a display screen to respectively select the respective item states for each of the at least two items.

* * * * *